US011760532B2

(12) United States Patent
Mayer

(10) Patent No.: US 11,760,532 B2
(45) Date of Patent: Sep. 19, 2023

(54) TAMPER EVIDENT CARTON

(71) Applicant: Inno-Pak, LLC, Delaware, OH (US)

(72) Inventor: Steven A. Mayer, Indianapolis, IN (US)

(73) Assignee: Inno-Pak, LLC, Delaware, OH (US)

( * ) Notice: Subject to any disclaimer, the term of this patent is extended or adjusted under 35 U.S.C. 154(b) by 44 days.

(21) Appl. No.: 17/587,629

(22) Filed: Jan. 28, 2022

(65) Prior Publication Data

US 2022/0153469 A1 May 19, 2022

Related U.S. Application Data

(63) Continuation of application No. 29/733,282, filed on Apr. 30, 2020, now Pat. No. Des. 943,412.

(51) Int. Cl.
*B65D 5/54* (2006.01)
*B65D 5/20* (2006.01)

(52) U.S. Cl.
CPC ..... *B65D 5/5455* (2013.01); *B65D 5/2061* (2013.01); *B65D 2401/15* (2020.05)

(58) Field of Classification Search
CPC ..... B65D 5/541; B65D 5/545; B65D 5/5455; B65D 5/546; B65D 5/6635; B65D 5/6656;

(Continued)

(56) References Cited

U.S. PATENT DOCUMENTS 838,964 A * 12/1906 Dobson et al. ..... B65D 27/22 229/84
1,537,956 A 5/1925 Meyers
(Continued)

FOREIGN PATENT DOCUMENTS

CN 2347943 Y 11/1999
DE 2733041 A1 2/1978
(Continued)

OTHER PUBLICATIONS

Bowl Sleeve, The Custom Packaging Boxes, Available from internet, https://thecustompackagingboxes.com/boxes-by-style/bowl-sleeve/, 2018, 04 pages.

(Continued)

*Primary Examiner* — Nathan J Newhouse
*Assistant Examiner* — Phillip D Schmidt
(74) *Attorney, Agent, or Firm* — Ward and Smith, P.A.; Ryan K. Simmons

(57) ABSTRACT

A tamper evident carton. The tamper evident carton may include a floor panel; side panels extending about a periphery of the floor panel; corner gussets extending between adjacent side panels, wherein the bottom panel, side panels, and corner gussets may be configurable to form a compartment region; first and second lid flaps extending from an uppermost edge of their respective side panels forming first and second moveable joints, respectively, therebetween, and the first and second lid flaps may each include an interlocking feature, such that the first and second lid flaps may interlock with one another when in a folded closed configuration; third and fourth lid flaps extending from an uppermost edge of their respective side panels forming third and fourth moveable joints, respectively, therebetween, and the third and fourth lid flaps may each include an interlocking feature, such that the third and fourth lid flaps may interlock with one another when in a folded closed configuration.

19 Claims, 13 Drawing Sheets

(58) Field of Classification Search
CPC ..... B65D 5/2057; B65D 5/2061; B65D 5/24; B65D 5/241; B65D 2401/15; B65D 2401/20
USPC ..... 229/240, 241, 244, 221, 222, 155; 206/807
See application file for complete search history.

(56) References Cited

U.S. PATENT DOCUMENTS

D73,127 S 7/1927 Greve
1,792,885 A 2/1931 Andrews
1,837,602 A * 12/1931 Walter ..... B65D 5/26 229/160
1,987,545 A 1/1935 Taylor
2,019,870 A 11/1935 Perry
2,050,967 A 8/1936 Farmer
2,062,949 A 12/1936 Taylor
D106,826 S 11/1937 Dieffenbach
2,128,196 A 8/1938 Max
2,149,030 A 2/1939 Arlington
D126,123 S 3/1941 Clemens
2,341,762 A 2/1944 Conklin
2,355,729 A 8/1944 Inman
2,409,736 A 10/1946 Caimi
2,475,294 A 7/1949 Rafoth
D158,362 S 5/1950 Dischler
2,568,170 A 9/1951 Ringler
2,693,836 A 11/1954 Hayes
2,786,572 A 3/1957 Gentry
2,793,801 A 5/1957 John
2,814,381 A 11/1957 Wade
2,823,797 A 2/1958 Harold
2,846,134 A 8/1958 Esber
D183,716 S 10/1958 James
2,927,502 A 3/1960 Watrous
2,934,255 A 4/1960 McDuffie
3,027,063 A 3/1962 Zastrow
D194,246 S 12/1962 Engelmann
3,084,790 A 4/1963 Lugt, Jr.
3,101,166 A 8/1963 Antwerpen
3,128,030 A 4/1964 Davies
D200,249 S 2/1965 Hancock
3,203,621 A 8/1965 Wright
3,212,907 A 10/1965 Carlo
3,244,353 A 4/1966 Miessler, Sr.
D205,970 S 11/1966 Leifeld
D208,067 S 7/1967 Heirich
3,362,609 A 1/1968 Freedy
3,367,557 A 2/1968 Farquhar
3,372,812 A 3/1968 Parcels
D211,564 S 7/1968 Bailey
3,391,816 A 7/1968 Swett
D212,495 S 10/1968 Stageberg
3,443,681 A 5/1969 Wysocki
D214,523 S 6/1969 Stone
3,462,066 A * 8/1969 Farquhar ..... B65D 5/106 229/102
D217,441 S 5/1970 Kanaga
D219,263 S 11/1970 Castelli et al.
3,559,866 A 2/1971 Olson, Sr.
3,586,173 A 6/1971 Reynolds
3,591,032 A 7/1971 Baxter
3,595,425 A 7/1971 Eicholtz et al.
3,604,614 A 9/1971 Sternfeld
3,610,512 A 10/1971 Hermalin
3,640,380 A 2/1972 Huffman
D224,090 S 7/1972 Cyr et al.
3,701,181 A 10/1972 Lock
3,770,188 A 11/1973 Norman
D229,485 S 12/1973 Peterson
3,811,613 A 5/1974 Harrison
D232,302 S 8/1974 Lazure
D232,524 S 8/1974 Schy
D233,083 S 10/1974 Rosa
3,853,220 A 12/1974 Luray
D241,016 S 8/1976 Reynold
3,994,213 A 11/1976 Brezinski
D246,491 S 11/1977 D'Alo
4,063,678 A * 12/1977 Hall ..... B65D 5/106 229/222
4,101,049 A 7/1978 Wallace et al.
4,195,732 A 4/1980 Bell
D255,011 S 5/1980 Cooper et al.
4,243,171 A 1/1981 Prin
D259,615 S 6/1981 Morris, Jr.
4,276,982 A 7/1981 Sibrava et al.
D260,604 S 9/1981 Otto
D263,191 S 3/1982 Moore
4,369,913 A 1/1983 Muise
D276,137 S 10/1984 Vere et al.
D277,555 S 2/1985 Pattillo et al.
4,529,464 A 7/1985 Jones
D280,290 S 8/1985 Bakus
4,596,356 A 6/1986 Chaussadas
4,723,300 A 2/1988 Aranow
4,790,670 A 12/1988 Barbaro
4,832,199 A 5/1989 Rigby
4,844,328 A 7/1989 Cooper
4,846,398 A 7/1989 Johnson
D304,664 S 11/1989 Wyant
4,917,291 A * 4/1990 Saiki ..... B65D 75/14 229/922
4,955,981 A 9/1990 Provost
5,035,515 A 7/1991 Crossman et al.
5,058,744 A 10/1991 Creaden
5,096,113 A 3/1992 Focke
D329,376 S 9/1992 Burd
D334,867 S 4/1993 May
5,226,588 A 7/1993 Schramm et al.
5,226,941 A 7/1993 Uibel et al.
5,310,977 A 5/1994 Stenkamp et al.
5,322,182 A 6/1994 Fritz
D351,997 S 11/1994 Finnah
D352,203 S 11/1994 Campbell et al.
5,411,204 A * 5/1995 DeMay ..... B65D 5/244 229/114
5,419,451 A 5/1995 Bitel, Jr.
D363,192 S 10/1995 Rigby et al.
D363,856 S 11/1995 Westbrooks
5,484,059 A 1/1996 Sutherland
D367,172 S 2/1996 Craft et al.
5,507,428 A * 4/1996 Robinson, Jr. ..... B65D 5/0254 229/148
D371,940 S 7/1996 Krupa
D372,170 S 7/1996 Ahern
D372,864 S 8/1996 Hansen et al.
D376,953 S 12/1996 Dunn
5,593,755 A 1/1997 Fuss
5,608,949 A 3/1997 Cooley et al.
D381,180 S 7/1997 Butler et al.
D385,080 S 10/1997 Butler et al.
5,711,751 A 1/1998 Harmanoglu
D394,385 S 5/1998 Laughlin
D395,547 S 6/1998 Sussman
5,765,685 A 6/1998 Roosa
D397,294 S 8/1998 Saulas
D398,526 S 9/1998 Schwarz et al.
5,824,380 A 10/1998 Hagen
5,855,275 A 1/1999 Hunter et al.
5,873,220 A 2/1999 Haraldsson et al.
5,881,432 A 3/1999 Good
5,884,783 A 3/1999 Proulx
D409,908 S 5/1999 Besana
5,899,331 A 5/1999 Warren, Jr.
5,927,502 A 7/1999 Hunter
D412,398 S 8/1999 Watabe
5,971,168 A 10/1999 Proulx
D417,364 S 12/1999 Lin
6,142,440 A 11/2000 Gratz et al.
D438,797 S 3/2001 Bozlee
D440,118 S 4/2001 Claffy et al.
D442,085 S 5/2001 Bozlee
D442,859 S 5/2001 Hirschey
D444,703 S 7/2001 Allasia

(56) References Cited

U.S. PATENT DOCUMENTS

D445,311 S 7/2001 Emonet et al.
D446,092 S 8/2001 Cautereels
6,269,961 B1 8/2001 Porcelli
6,273,278 B1 8/2001 Enyedy et al.
D448,130 S 9/2001 Wagner
6,286,681 B1 9/2001 Wilfong, Jr. et al.
D451,389 S 12/2001 Bozlee
D451,769 S 12/2001 Stanos et al.
D454,495 S 3/2002 Bryan et al.
6,361,209 B1 3/2002 Larue et al.
D460,689 S 7/2002 Robinson
D461,406 S 8/2002 Iacovelli
D462,904 S 9/2002 Mellon et al.
6,474,613 B2 11/2002 Omalley
D467,798 S 12/2002 Cohon
6,612,482 B2 9/2003 Ross
D484,364 S 12/2003 Bailey et al.
D484,799 S 1/2004 Hoffman et al.
D490,703 S 6/2004 Rusnock
D495,251 S 8/2004 Zack
D497,309 S 10/2004 Nordland et al.
D499,607 S 12/2004 Lyon
D500,674 S 1/2005 Chou
D501,134 S 1/2005 Takahashi et al.
D502,872 S 3/2005 Fleming
D504,813 S 5/2005 Chou
6,913,389 B2 7/2005 Kannankeril et al.
D509,733 S 9/2005 Jongens
D512,836 S 12/2005 Marnell, II
7,004,314 B2 2/2006 Pucillo et al.
7,004,632 B2 2/2006 Hamilton et al.
D519,366 S 4/2006 Epstein
D519,830 S 5/2006 Yocum
D521,376 S 5/2006 Mosto
D521,862 S 5/2006 Siethoff et al.
7,090,272 B2 8/2006 Novakovich et al.
D531,498 S 11/2006 Fluegel et al.
D536,612 S 2/2007 Geurts et al.
D542,129 S 5/2007 Moorman
D549,456 S 8/2007 Dretzka
D549,457 S 8/2007 Dretzka
D557,047 S 12/2007 Dretzka
D561,023 S 2/2008 Jacxsens
D561,408 S 2/2008 Marsh
D562,125 S 2/2008 Kienemund-Paroll
D563,673 S 3/2008 Dretzka
D567,671 S 4/2008 Say
D568,765 S 5/2008 Miles
D573,408 S 7/2008 Lovett
D573,409 S 7/2008 Lovett
D576,482 S 9/2008 Debusk
7,427,161 B2 9/2008 Sill et al.
D578,387 S 10/2008 Lovett
D582,268 S 12/2008 Zanaletti
D582,791 S 12/2008 Elmerhaus
D584,108 S 1/2009 Olsson
D590,596 S 4/2009 Dretzka
D595,155 S 6/2009 Larson
D596,027 S 7/2009 Kalberer
D596,448 S 7/2009 Nolan
D596,449 S 7/2009 Nolan
D596,903 S 7/2009 Willis et al.
7,565,997 B1 7/2009 Lim
D599,611 S 9/2009 Hoekstra
D605,896 S 12/2009 Zalewski et al.
D608,153 S 1/2010 Furlong
D615,822 S 5/2010 Klein
D617,636 S 6/2010 Vanhoutte
D622,139 S 8/2010 Marcott et al.
D627,612 S 11/2010 Falk et al.
D630,508 S 1/2011 Hubbard et al.
D630,885 S 1/2011 Stein
D631,352 S 1/2011 Gilfert
D631,741 S 2/2011 Hubbard et al.
D631,742 S 2/2011 Hubbard et al.
D631,743 S 2/2011 Hubbard et al.
D633,341 S 3/2011 Smyers
D635,469 S 4/2011 Buitrago
D637,035 S 5/2011 Zorovich et al.
D641,256 S 7/2011 Fisher
7,984,806 B2 7/2011 Matheou
D642,934 S 8/2011 Ly
D643,311 S 8/2011 Meyers
D645,708 S 9/2011 Stamper et al.
8,033,447 B2 10/2011 Katoh
8,061,585 B2 11/2011 Nikolai et al.
D649,838 S 12/2011 Stamper et al.
D652,316 S 1/2012 Ren et al.
D653,496 S 2/2012 Henry
D657,261 S 4/2012 De Gast
D665,271 S 8/2012 Halty et al.
D665,628 S 8/2012 Mayer
D669,352 S 10/2012 Paslawski
D674,690 S 1/2013 Sill
D675,092 S 1/2013 Sill
D675,520 S 2/2013 Sill
D675,920 S 2/2013 Sill
D676,742 S 2/2013 Walter et al.
D678,760 S 3/2013 Cooper
D678,761 S 3/2013 Cooper
D678,762 S 3/2013 Cooper
D678,779 S 3/2013 Lee
D679,950 S 4/2013 Cooper
D682,085 S 5/2013 Hannant et al.
D682,684 S 5/2013 Walter et al.
D684,465 S 6/2013 Vernon et al.
D684,858 S 6/2013 Sill
D688,552 S 8/2013 Vernon et al.
D688,572 S 8/2013 Marin
D688,921 S 9/2013 Miros et al.
D691,035 S 10/2013 Sill
D693,180 S 11/2013 Peterson et al.
D693,215 S 11/2013 Sill
D693,216 S 11/2013 Sill
D693,217 S 11/2013 Sill
D693,218 S 11/2013 Sill
D693,646 S 11/2013 Katterheinrich et al.
D693,679 S 11/2013 Sill
D695,101 S 12/2013 Keberlein et al.
D695,104 S 12/2013 Sill
D695,107 S 12/2013 Clements
D695,575 S 12/2013 Katz
D695,605 S 12/2013 Johnson
D697,789 S 1/2014 Gerdes et al.
D698,644 S 2/2014 Teopas
D699,101 S 2/2014 Strom
D706,128 S 6/2014 Strom
D706,132 S 6/2014 Sill
D707,042 S 6/2014 Ruzzenente
D707,123 S 6/2014 Marchetti et al.
D710,691 S 8/2014 Genender
D712,153 S 9/2014 Lee
D713,725 S 9/2014 Cedeno
D714,638 S 10/2014 Mohn et al.
D718,641 S 12/2014 Ryan et al.
8,939,350 B2 1/2015 Valencia
D726,533 S 4/2015 Northrup
D727,724 S 4/2015 Pipes et al.
D727,732 S 4/2015 Petty
D728,359 S 5/2015 Iwegbu
D728,364 S 5/2015 Baker et al.
D730,178 S 5/2015 Fullan
D731,325 S 6/2015 Loessin
D735,576 S 8/2015 Aldridge
D737,820 S 9/2015 Yu et al.
D739,766 S 9/2015 Glass et al.
D742,759 S 11/2015 Ryan et al.
9,211,970 B2 12/2015 Hubbard et al.
9,212,842 B2 12/2015 Vasbinder et al.
9,216,837 B2 12/2015 Hubbard et al.
D746,643 S 1/2016 Kraemer
D746,671 S 1/2016 Fohner et al.
D752,429 S 3/2016 Mayer
9,309,023 B2 4/2016 Hubbard et al.

(56) References Cited

U.S. PATENT DOCUMENTS

| | | | | |
|---|---|---|---|---|
| D758,184 | S | 6/2016 | Tu et al. | |
| D760,036 | S | 6/2016 | Hucuptan | |
| D763,706 | S | 8/2016 | Shum et al. | |
| D764,276 | S | 8/2016 | Das et al. | |
| D764,281 | S | 8/2016 | Mayer | |
| D766,664 | S | 9/2016 | Wilson et al. | |
| D767,409 | S | 9/2016 | Nickell | |
| 9,434,513 | B2 | 9/2016 | Lux et al. | |
| D769,114 | S | 10/2016 | Montemayor | |
| D769,732 | S | 10/2016 | Shoshan | |
| D770,270 | S | 11/2016 | Mcgarry et al. | |
| D771,486 | S | 11/2016 | Mayer | |
| D772,053 | S | 11/2016 | Mayer | |
| D775,946 | S | 1/2017 | Ghini et al. | |
| D776,548 | S | 1/2017 | Bell | |
| D777,029 | S | 1/2017 | Stratton | |
| D778,115 | S | 2/2017 | Strachan | |
| D778,155 | S | 2/2017 | Strachan | |
| D778,722 | S | 2/2017 | Strachan | |
| D779,271 | S | 2/2017 | Simon | |
| D784,769 | S | 4/2017 | Beckman et al. | |
| 9,630,748 | B2 | 4/2017 | Keller | |
| D786,621 | S | 5/2017 | Davis | |
| D786,976 | S | 5/2017 | Keating | |
| D792,160 | S | 7/2017 | Ng | |
| D792,161 | S | 7/2017 | Ng | |
| D792,211 | S | 7/2017 | Foster et al. | |
| D792,222 | S | 7/2017 | Sill et al. | |
| D792,761 | S | 7/2017 | Duval et al. | |
| D793,222 | S | 8/2017 | Boyea | |
| D793,868 | S | 8/2017 | Kim et al. | |
| D798,707 | S | 10/2017 | Mayer | |
| D798,736 | S | 10/2017 | Shoshan | |
| D801,826 | S | 11/2017 | Austin et al. | |
| D809,849 | S | 2/2018 | Lee | |
| D809,930 | S | 2/2018 | Kagawa | |
| D809,931 | S | 2/2018 | Kagawa | |
| D811,896 | S | 3/2018 | Wigman et al. | |
| D812,490 | S | 3/2018 | Wigman et al. | |
| D814,929 | S | 4/2018 | Bergeron et al. | |
| D815,941 | S | 4/2018 | Haddad | |
| D815,955 | S | 4/2018 | Park et al. | |
| D818,316 | S | 5/2018 | Disraeli | |
| D821,223 | S | 6/2018 | Tan | |
| D823,486 | S | 7/2018 | Hassan | |
| 10,017,290 | B2 | 7/2018 | Faulkner et al. | |
| D826,043 | S | 8/2018 | Dacey et al. | |
| D828,099 | S | 9/2018 | Zhang | |
| D828,157 | S | 9/2018 | Paradis | |
| D828,763 | S | 9/2018 | Tan | |
| D828,766 | S | 9/2018 | Latour et al. | |
| D829,563 | S | 10/2018 | Park et al. | |
| D830,193 | S | 10/2018 | Park et al. | |
| D830,849 | S | 10/2018 | Tan | |
| D830,852 | S | 10/2018 | Sill et al. | |
| D836,449 | S | 12/2018 | Park et al. | |
| 10,167,134 | B2 | 1/2019 | Zeitlin et al. | |
| D840,232 | S | 2/2019 | Sill et al. | |
| 10,259,316 | B2 | 4/2019 | Lee et al. | |
| D849,553 | S | 5/2019 | Song et al. | |
| D850,932 | S | 6/2019 | Troudt et al. | |
| D850,933 | S | 6/2019 | Troudt et al. | |
| D854,942 | S | 7/2019 | Requena et al. | |
| D854,943 | S | 7/2019 | Requena et al. | |
| D858,270 | S | 9/2019 | Requena et al. | |
| D860,790 | S | 9/2019 | Sedgwick | |
| 860,807 | A1 | 9/2019 | Sill | |
| 10,398,243 | B2 | 9/2019 | Sedgwick | |
| D869,289 | S | 12/2019 | Sill et al. | |
| D875,530 | S | 2/2020 | Sill et al. | |
| D876,951 | S | 3/2020 | Sill et al. | |
| 11,186,406 | B2 * | 11/2021 | Chapman | B65D 5/667 |
| 11,465,798 | B2 * | 10/2022 | Epstein | H04W 76/19 |
| 2002/0063194 | A1 | 5/2002 | O'malley | |
| 2002/0108955 | A1 | 8/2002 | Erb | |
| 2003/0217946 | A1 | 11/2003 | Hsu | |
| 2004/0182916 | A1 * | 9/2004 | Roseth | B65D 5/546 229/114 |
| 2005/0023234 | A1 | 2/2005 | Head | |
| 2005/0041894 | A1 | 2/2005 | Hanson | |
| 2005/0047686 | A1 | 3/2005 | Elsaesser | |
| 2005/0051461 | A1 | 3/2005 | Bryant | |
| 2005/0103674 | A1 | 5/2005 | Matheou | |
| 2005/0124521 | A1 | 6/2005 | Sadlowski et al. | |
| 2005/0150788 | A1 | 7/2005 | Feusner | |
| 2006/0045390 | A1 | 3/2006 | Sill et al. | |
| 2006/0196787 | A1 | 9/2006 | Lewis | |
| 2007/0074993 | A1 | 4/2007 | Philips | |
| 2007/0163449 | A1 | 7/2007 | Hart | |
| 2007/0178194 | A1 | 8/2007 | Everard | |
| 2007/0292053 | A1 | 12/2007 | Lin et al. | |
| 2008/0269034 | A1 | 10/2008 | Stier | |
| 2008/0286431 | A1 | 11/2008 | Brown | |
| 2009/0186132 | A1 | 7/2009 | Mangino et al. | |
| 2010/0065620 | A1 | 3/2010 | Smith | |
| 2010/0112292 | A1 | 5/2010 | Gilfert | |
| 2011/0094918 | A1 | 4/2011 | Hernandez | |
| 2011/0120993 | A1 | 5/2011 | Birchmeier et al. | |
| 2011/0240653 | A1 | 10/2011 | Castner et al. | |
| 2012/0234904 | A1 | 9/2012 | Costanzo, Jr. | |
| 2013/0134067 | A1 | 5/2013 | Ramirez et al. | |
| 2013/0315507 | A1 | 11/2013 | Teixido Vidal et al. | |
| 2014/0203070 | A1 | 7/2014 | Lee | |
| 2014/0263353 | A1 | 9/2014 | Bell | |
| 2014/0263600 | A1 | 9/2014 | Valencia | |
| 2015/0360821 | A1 | 12/2015 | Greenwood et al. | |
| 2016/0107830 | A1 | 4/2016 | Baryshyan | |
| 2017/0295974 | A1 | 10/2017 | Lai | |
| 2018/0339807 | A1 | 11/2018 | Mobarhan | |
| 2019/0053652 | A1 | 2/2019 | Sedgwick | |
| 2019/0112116 | A1 | 4/2019 | Su et al. | |
| 2019/0322409 | A1 | 10/2019 | Sill et al. | |
| 2019/0367207 | A1 | 12/2019 | Gathercole | |
| 2020/0391903 | A1 * | 12/2020 | Donschietz | B65D 5/5455 |
| 2021/0086950 | A1 | 3/2021 | Sill et al. | |
| 2021/0292041 | A1 | 9/2021 | Inwood | |

FOREIGN PATENT DOCUMENTS

| | | | | |
|---|---|---|---|---|
| DE | 29500157 | U1 | 2/1995 | |
| DE | 19831584 | A1 | 1/2000 | |
| DE | 10-2009-007985 | A1 | 2/2010 | |
| DE | 202010001585 | U1 * | 9/2011 | B65D 5/2047 |
| EP | 0 515 086 | A1 | 11/1992 | |
| FR | 2838406 | A1 | 10/2003 | |
| GB | 487330 | A | 6/1938 | |
| GB | 2088269 | | 11/1999 | |
| JP | 2017-061324 | A | 3/2017 | |
| NL | 1040069 | C2 | 8/2014 | |
| WO | 2004071890 | A1 | 8/2004 | |

OTHER PUBLICATIONS

Food packaging sleeves, Ostle & Maillard, 2019, 04 pages.

Alibaba, "Black Disposable Divided Food Trays", Available from Internet, <URL:https://thai.alibaba.com/product-detail/Airline-disposable-plastic-four-compartment-CPET-1238104653.html>, accessed on Apr. 3, 2017, Oct. 1, 2013, 9 pages.

Alibaba, "Disposable Plastic Two Compartment Food Container", https://www alibaba.com/product-detail/Disposable-plastic-two-cornpartment-food-container_60599614850.html, 2018, 8 pages.

Amazon, "Dart 205HT2, 9x6x3-Inch Performer White Two Compartment Foam Container with a Removable Hinged Lid, Carryout Food Disposable Containers", Available on amazon.com/DART-205HT2-9x6x3-Inch-Compartment-Disposable/dp/B01LWTYPEW/ref=sr_1_2?keywords=Dart+205HT2&qid=1572602603&sr=8-2, Sep. 12, 2016, 6 pages.

Amazon, "Food Containers 3 Compartment Premium", Available from <URL: https://www.amazon.com/dp/B0741BQMY7/ref=sspa_dk_detail_2?psc=1%20&pd_rd_i=B0741BQMY7&pd_rd_wg=gDStp%20&pd_rd_r=ACEV1YJAC97ZZPCCXWCW&pd_rd_w=XZKtg>, Accessed on Mar. 8, 2018, Jul. 18, 2017, 9 pages.

(56) References Cited

OTHER PUBLICATIONS

Amazon, "Freshware Meal Prep Containers [30 Pack] 3 Compartment with Lids, Food Storage Containers, Bento Box | BPA Free | Stackable | Microwave/Dishwasher/Freezer Safe (32 oz)", Feb. 13, 2019, 9 pages.
Amazon, "Pactiv RCL750200, 3-Compartment Aluminum Foil Pans Combo with Flat Foil Lids, Take Out Disposable Foil Containers with Matching Covers", Available at https://www.amazon.com/Pactiv-RCL750200-3-Compartment-Disposable-Containers/dp/B01LXOJ7BP/ref=sr_1_1 ?keywords=Pactiv+RCL750200&qid=1572606252&sr=8-1, Sep. 28, 2016, 5 pages.
Amazon, "Southern Champion Tray 0731 #1 ChampPak Classic Take-Out Container, Kraft Paperboard Coated Inside", Southern Champion Tray, Jan. 17, 2013, 1 page.
Amazon, "Southern Champion Tray 23133K Kraft Paperboard Lock Corner Window Bakery Box", Available from internet https ://www.amazon.com/gp/product/B008WCWJ9S/ref=s9_zwish_hd_bw_g328J1?pf_rd_m=ATVPDKIKXODER&pf_rd_s=merchandised-search-5&pf_rd_r=OF299N2PNPMAY8WZM12D&pf_rd_t=101&pf_rd_p=2223275202&pf_rd_i=5016466011, Mar. 15, 2013, 1 page.
Amazon.com, "50 Paper Food to Go Containers—51 oz—New Design with Waist Seal Band—Eco Friendly Disposable Kraft Paper Take Out Food Container—Sturdy Leak & Grease Proof Microwavable Take Away Boxes", retrieved from web on Nov. 5, 2019, available on https://www.amazon.com/Paper-Food-Containers-Disposable-Microwavable/dp/B07M74VWXW, 6 pages.
Blair Candy, "Empty Candy Boxes", Available at https://www.blaircandy.com/emcabo.html, accessed on Oct. 30, 2015, 2013, 1 page.
Dean Supply, "Disposable Takeout Containers", Jul. 18, 2017, 9 pages.
Flex Active Sports, "Buy 3-Compartment Food Prep Containers", Available from Internet, <URL:http://flexactivesports.com/buy-3-compartment-food-prep-containers/>, accessed on Apr. 17, 2017, Jan. 5, 2016, 14 pages.
Glynn Robin, "Origami Treasure Chest", Available at https://www.youtube.com/watch?v=WpgGqeBQvj4, accessed on Oct. 30, 2015, Nov. 29, 2010, 1 page.
Importitall, "Southern Champion Tray 0761 #1", ChampPak Retro Take-Out, Jul. 13, 2017, 1 page.
Importitall, "Southern Champion Tray 0764 #4", ChampPak Retro Take-Out, Jul. 13, 2017, 1 page.
Inno-Pak, "Innobox Edge Insert", Oct. 25, 2016, 3 pages.
JCPAK, "Cardboard Sleeves for Food Tray", Cartons and Boxes, Available from Internet, http://www.jchengpackage.com/Cartons_and_Boxes/28.html, 2018, 02 pages.
Kalifornia Love, "Extra Fruit Sensations Sweet Watermelon", Available at http://www.kalifornialove.com/2010/07/extra-fruit-sensations-sweet-watermelon.html, accessed on Nov. 4, 2016, Jul. 28, 2010, 20 pages.
Nearof, "Review: Stride Spark Vitamin Chewing Gum", Available at http://www.nearof.com/review-stride-spark-vitamin-chewing-gum/, accessed on Nov. 4, 2016, Sep. 7, 2011, 4 pages.
Placon, "Fresh n Clear Go Cubes Black Insert Tray", https://www.placon.com/products/stock-food-package/fresh-n-clear-gocubes-black-insert-tray/>, 2016, 2 pages.
Robives, "Curved Lid Box", Nov. 2, 2013, 1 page.
Sabert, "Pulp Divided Taco Tray Insert", Available at https://www.sabert.com/products/pulp-divided-taco-tray-insert, Accessed on Mar. 27, 2019, Mar. 27, 2019, 7 pages.
Shutterstock, "Empty Food Tray Sleeve Packaging with Handles and Blueprint Template", Available from Internet, https://www.shutterstock.com/image-illustration/empty-food-tray-sleeve-packaging-handles-288654425?rid=928534, 08 pages.
Splash Packaging, "Natural Kraft Windowed Boxes", Available from internet, https://www.splashpackaging.com/window-bakery-boxes-kraft.html, Oct. 4, 2014, 1 page.
The Delaware Gazette, "Inno-Pak is Staying Put", Available at https://www.delgazette.com/news/295/inno-pak-is-staying-put, accessed on Dec. 11, 2015, Jun. 13, 2015, 1 page.
The Dumbbelle, "Fitness Meal Prep Containers for Healthy Living", Available at https://thedumbbelle.com/fitness-meal-prep-containers/, accessed on May 3, 2019, 9 pages.
Webstaurant Store, "Cambro 9113CW414 Camwear Teal 9" x 11" 3 Compartment Meal Delivery Tray", Available from <URL: https://www.webstaurantstore.com/cambro-9113cw414-camwear-teal-9-x-11-3-compartment-meal-delivery-tray-case/2149113CWTE.html>, accessed on Apr. 17, 2017, Mar. 14, 2010, 4 pages.
Webstaurantstore.com, "Choice 7 3/4" x 5 1/2" x 2" Kraft Microwavable Folded Paper #2 Take-Out Container—200/Case", retrieve from web on Nov. 5, 2019, available on https://www.webstaurantstore.com/choice-8-1-2-x-6-x-2-kraft-microwavable-folded-paper-2-take-out-container-case/795PTOKFT2.html, 6 pages.
Westrock, "Fold-Pak—Bio-Plus Earth", retrievedfrom web on Nov. 5, 2019, available on http://www.fold-pak.com/products/Bio-PlusEarth.htm, 2 pages.
Youtube, "Inno-Pak Rigid Microwavable Take Out Containers", Available from <URL:https://www.youtube.com/watch?v=WolGFg_sHSk>, accessed on Feb. 2, 2017, Sep. 17, 2014, 1 page.
International Search Report and Written Opinion from International Application No. PCT/US2019/030891, dated Jul. 26, 2019, 13 pages.
Made-in-China. Small Custom Design Kraft Food Gift Origami Paper Packaging Box with Lid. Publication date unavailable. Visited Nov. 23, 2021. https://engytech.en.made-in-china.com/product/zygnjLdSQXVo/China-Factory-Price-Small-Custom-Design-Kraft-Food-Gift-Origami-Paper-Packaging-Box-with-Lid.html (Year: 0).
Inno-Pak Handle Cuffs; Announced Aug. 24, 2020 (online). Site visited [Oct. 20, 2021]. Available from internet URL: https://www.Innopak.com/products/handle-cuffs/.

* cited by examiner

TAMPER EVIDENT CARTON

RELATED APPLICATIONS

This application is a continuation patent application of U.S. patent application Ser. No. 29/733,282, filed Apr. 30, 2020, the disclosure of which is incorporated herein by reference in its entirety.

TECHNICAL FIELD

The presently disclosed subject matter relates generally to cartons and more particularly to a tamper evident carton.

BACKGROUND

Various products are known to be purchased by consumers which require a carton for ease of transport. For example, in the food and grocery industry it is common to place food items in individual carry-out food cartons. There may be certain drawbacks to commonly used carry-out food cartons. For example, cardboard-, paper-, and/or paperboard-based cartons may be designed in a fashion that cannot ensure that the contents have been held secure in an untampered with state.

SUMMARY

In one embodiment, a tamper evident carton is provided. The tamper evident carton may include a floor panel; side panels extending about a periphery of the floor panel; corner gussets extending between adjacent side panels, wherein the bottom panel, side panels, and corner gussets may be configurable to form a compartment region; a first lid flap and a second lid flap opposite that of the first lid flap, wherein the first lid flap may extend from an uppermost edge of a first one of the side panels forming a first moveable joint therebetween, and the second lid flap may extend from an uppermost edge of a second one of the side panels opposite that of the first side panel forming a second moveable joint therebetween, and wherein the first lid flap and second lid flap may include a first interlocking feature and a second interlocking feature, respectively, such that the first lid flap and second lid flap may be configured to interlock with one another when in a folded closed configuration; a third lid flap and a fourth lid flap opposite that of the third lid flap, wherein the third lid flap may extend from an uppermost edge of a third one of the side panels forming a third moveable joint therebetween, and the fourth lid flap may extend from an uppermost edge of a fourth one of the side panels opposite that of the third side panel forming a fourth moveable joint therebetween, and wherein the third lid flap and fourth lid flap may include a third interlocking feature and a fourth interlocking feature, respectively, such that the third lid flap and fourth lid flap may be configured to interlock with one another when in a folded closed configuration; and a tear strip disposed in one of the third lid flap or fourth lid flap. The first interlocking feature of the first lid flap may include a first locking tab and slot and the second interlocking feature of the second lid flap may include a corresponding second locking tab and slot, wherein the slot of the first locking tab and the slot of the corresponding second locking tab may be configure to engage and interlock with one another to secure the first lid flap and the second lid flap in the folded closed configuration. The third interlocking feature of the third lid flap may include a locking tab extending from an upper portion of the third lid flap, and wherein the locking tab may include two folding tabs, one extending perpendicular out from each side of the locking tab. The fourth lid flap may include a folding portion extending from an uppermost edge of the fourth lid flap forming a fifth moveable joint therebetween, and wherein the folding portion may include a locking tab slot formed in the fifth moveable joint. The locking tab slot may be configured to receive the locking tab with the two folding tabs in a folded position, wherein in the folded position the two folding tabs may be folded substantially flat against a surface of the locking tab. The two folding tabs may be configured to unfolded to a degree once fully inserted through the locking tab slot. Once fully inserted through the locking tab slot the two folding tabs may be configured to unfolded to a degree such that the locking tab cannot be removed from the locking tab slot without causing visible damage to at least one of the locking tab, locking tab slot, and/or one or both of the two folding tabs. The tear strip may be disposed along a length of an upper portion of the third lid flap and below the third interlocking feature. Upon removal of the tear strip the third lid flap may be releasable from the folded closed configuration without unlocking the third interlocking feature from the fourth interlocking feature.

In another embodiment, a method of securing contents in a tamper evident carton is provided. The method may include providing a tamper evident carton providing a tamper evident carton; inserting contents into the compartment region; interlocking the first lid flap and the second lid flap together; and interlocking the third lid flap and the fourth lid flap together. Interlocking the first lid flap and the second lid flap together, may include folding the first lid flap and the second lid flap together and interlocking the first interlocking feature of the first lid flap with the second interlocking feature of the second lid flap. The first interlocking feature of the first lid flap may include a first locking tab and slot and the second interlocking feature of the second lid flap may include a corresponding second locking tab and slot, wherein the slot of the first locking tab and the slot of the corresponding second locking tab may be configure to engage and interlock with one another to secure the first lid flap and the second lid flap in the folded closed configuration. Interlocking the third lid flap and the fourth lid flap together, may include folding the third lid flap and the fourth lid flap together and interlocking the third interlocking feature of the third lid flap with the fourth interlocking feature of the fourth lid flap. The third interlocking feature of the third lid flap may include a locking tab extending from an upper portion of the third lid flap, and wherein the locking tab may include two folding tabs, one extending perpendicular out from each side of the locking tab. The fourth lid flap may include a folding portion extending from an uppermost edge of the fourth lid flap forming a fifth moveable joint therebetween, and wherein the folding portion may include a locking tab slot formed in the fifth moveable joint. Interlocking the third lid flap and the fourth lid flap together further may include, folding the two folding tabs into a folded position substantially flat against a surface of the locking tab and inserting the locking tab into the locking tab slot. The two folding tabs may be configured to unfolded to a degree once fully inserted through the locking tab slot. Once fully inserted through the locking tab slot the two folding tabs may be configured to unfolded to a degree such that the locking tab cannot be removed from the locking tab slot without causing visible damage to at least one of the locking tab, locking tab slot, and/or one or both of the two folding tabs.

In yet another embodiment, a method of providing access to contents in a secured tamper evident carton is provided. The method may include providing a secured tamper evident carton with contents therein; removing the tear strip; folding open the third lid flap and the fourth lid flap; unlocking the first interlocking feature of first lid flap from the second interlocking feature of the second lid flap; and folding open the first lid flap and the second lid flap. The tear strip may be disposed along a length of an upper portion of the third lid flap and below the third interlocking feature.

BRIEF DESCRIPTION OF THE DRAWINGS

Figure 1:
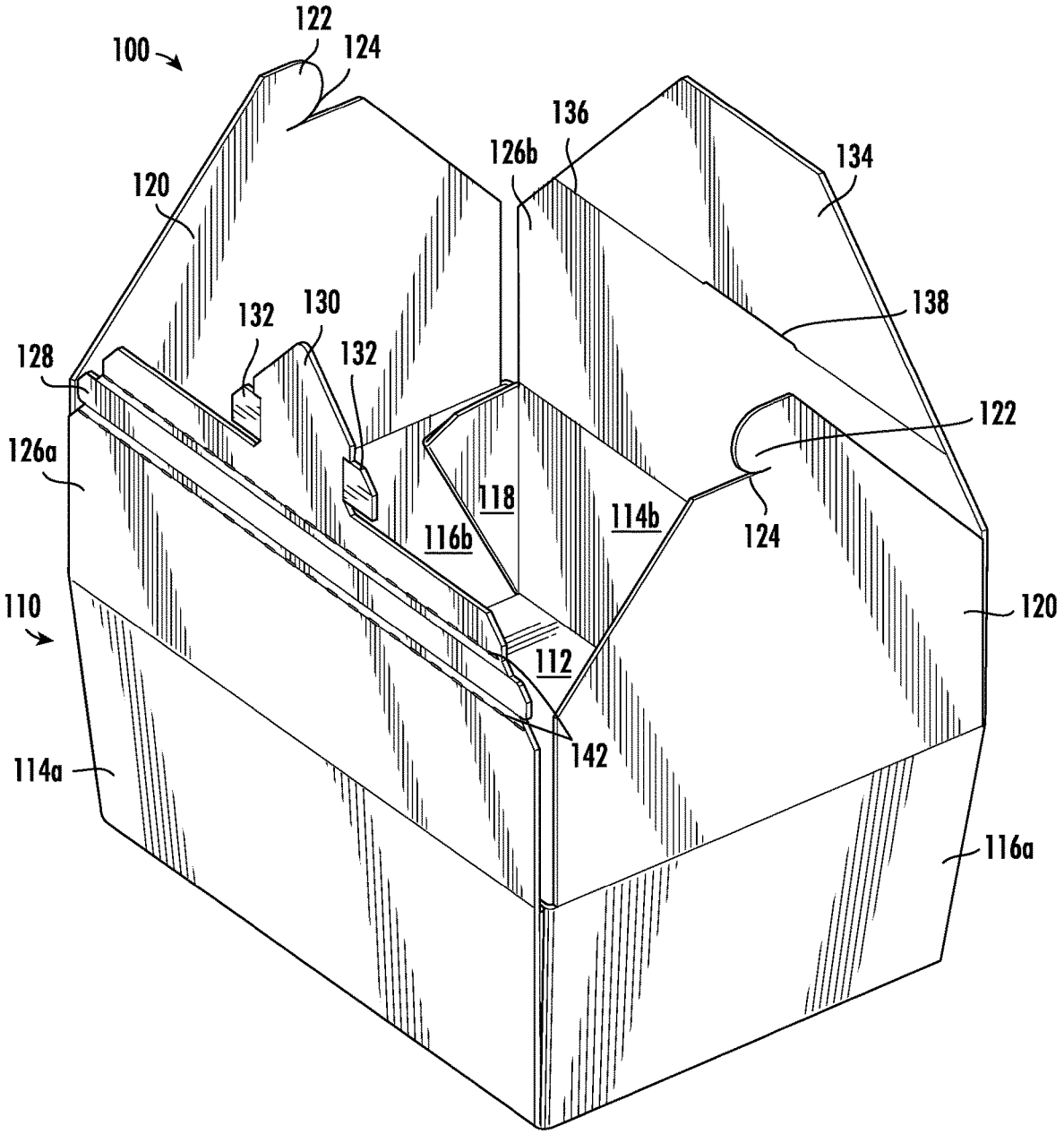
Figure 2:
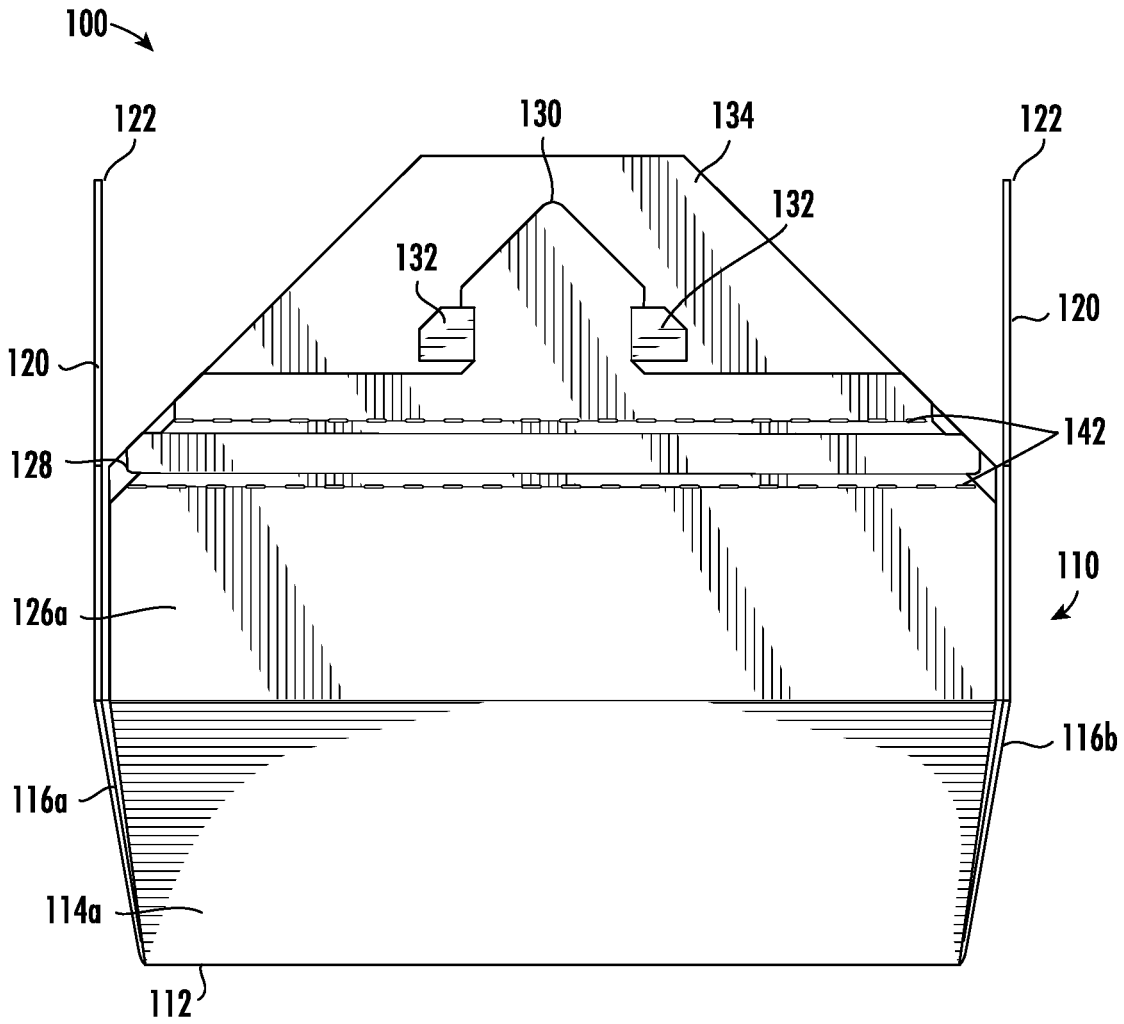
Figure 3:
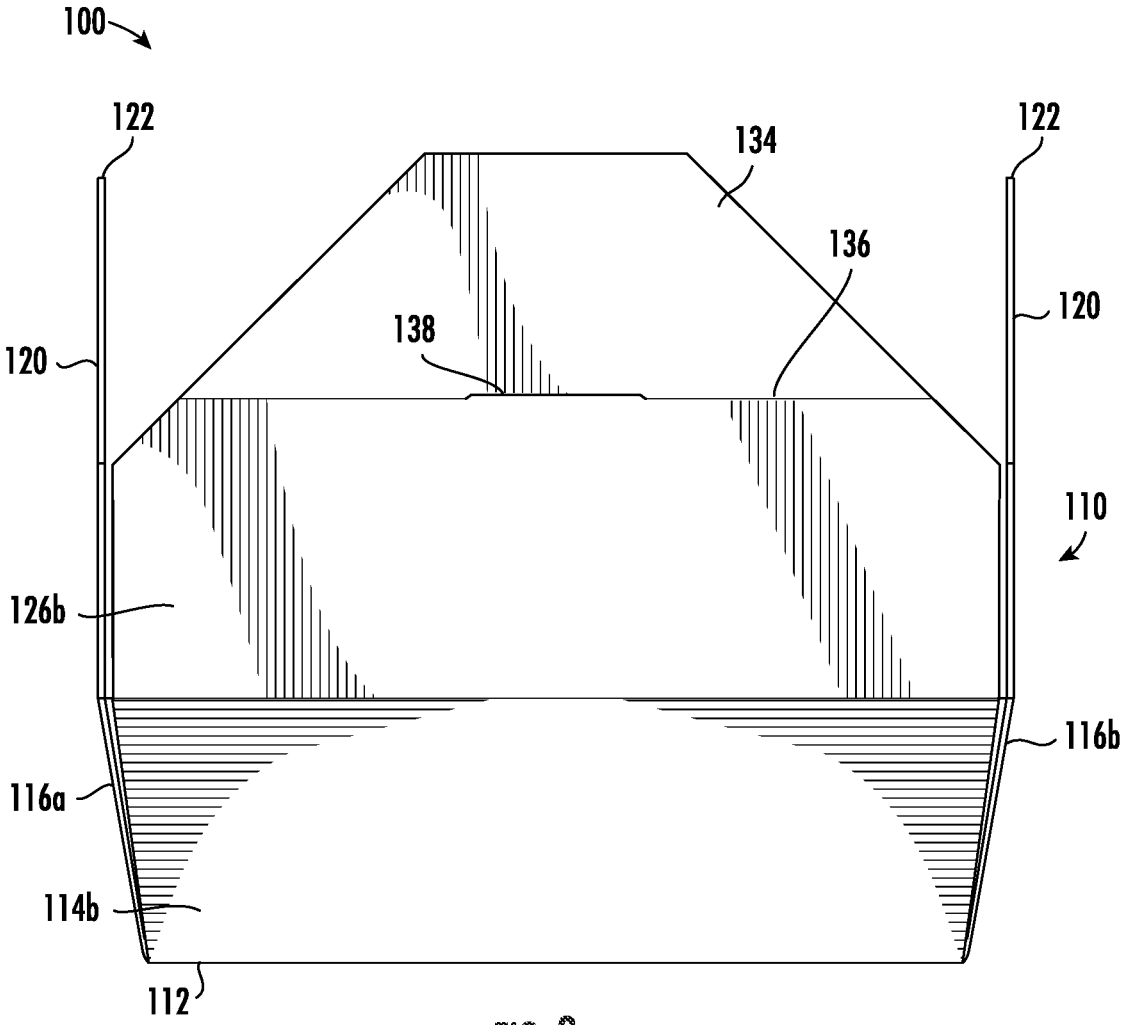
Figure 4:
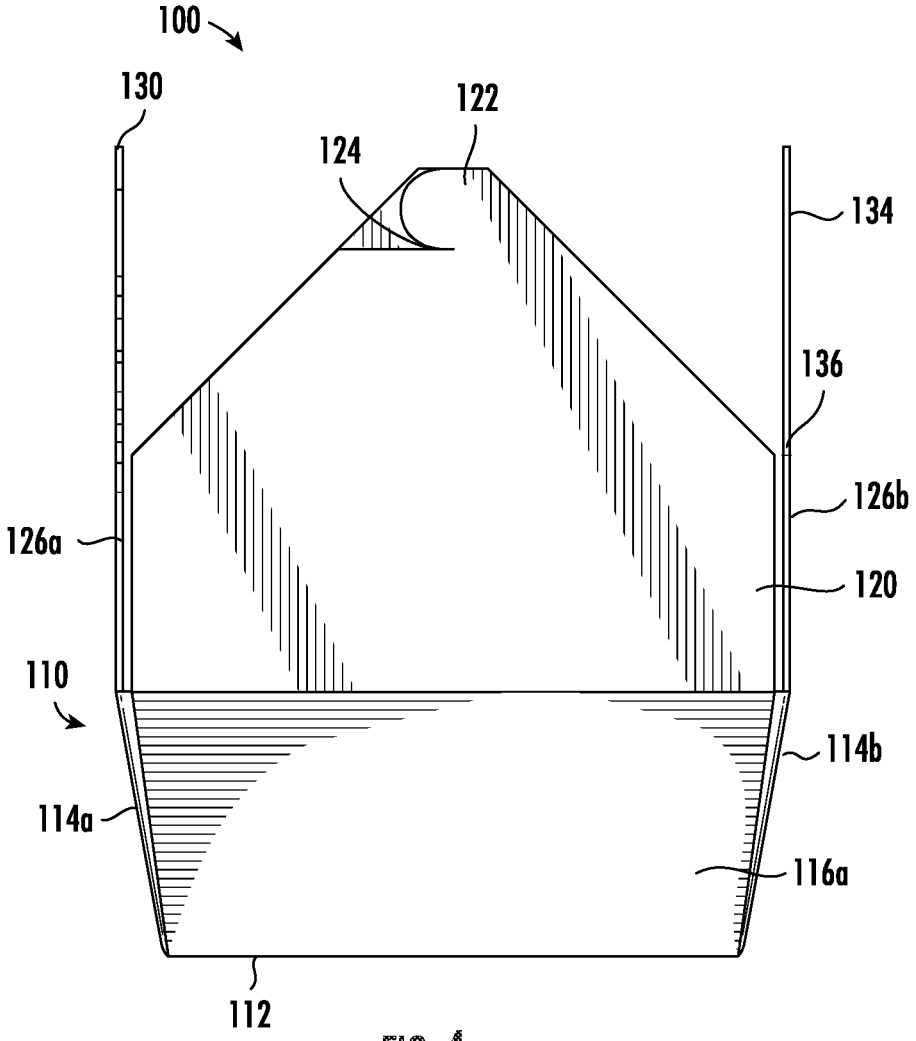
Figure 5:
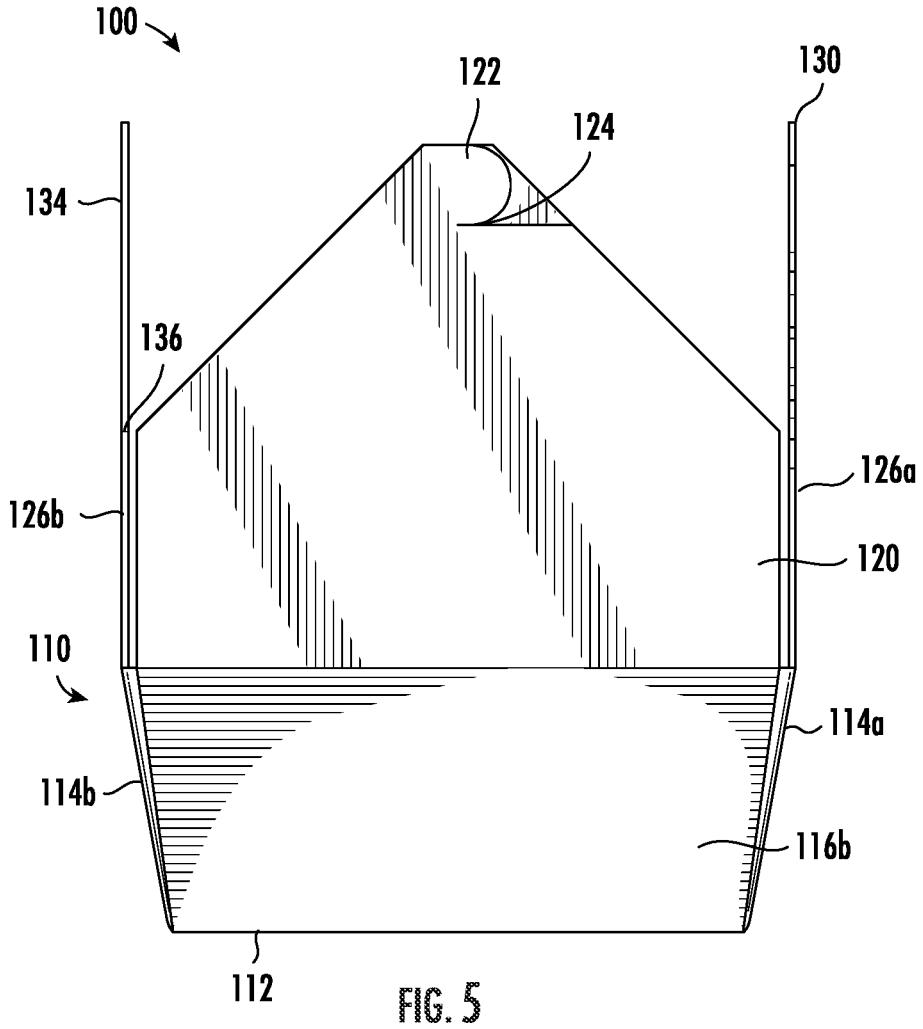
Figure 6:
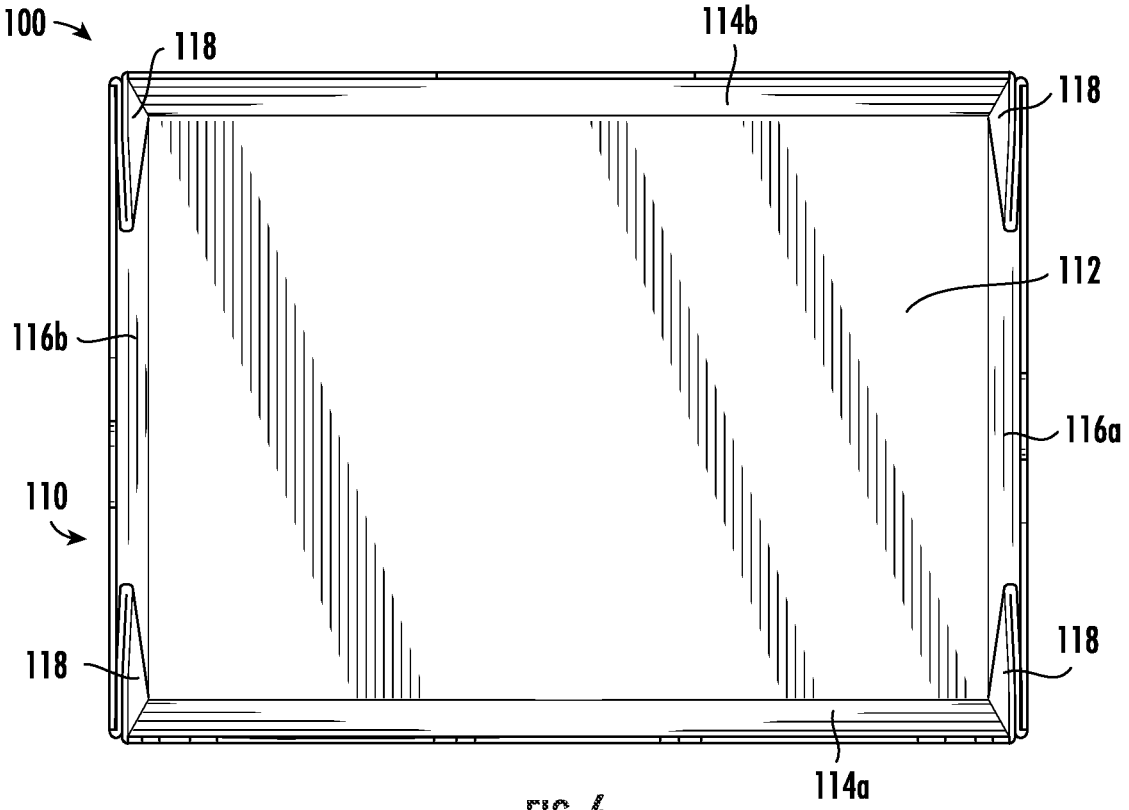
Figure 7:
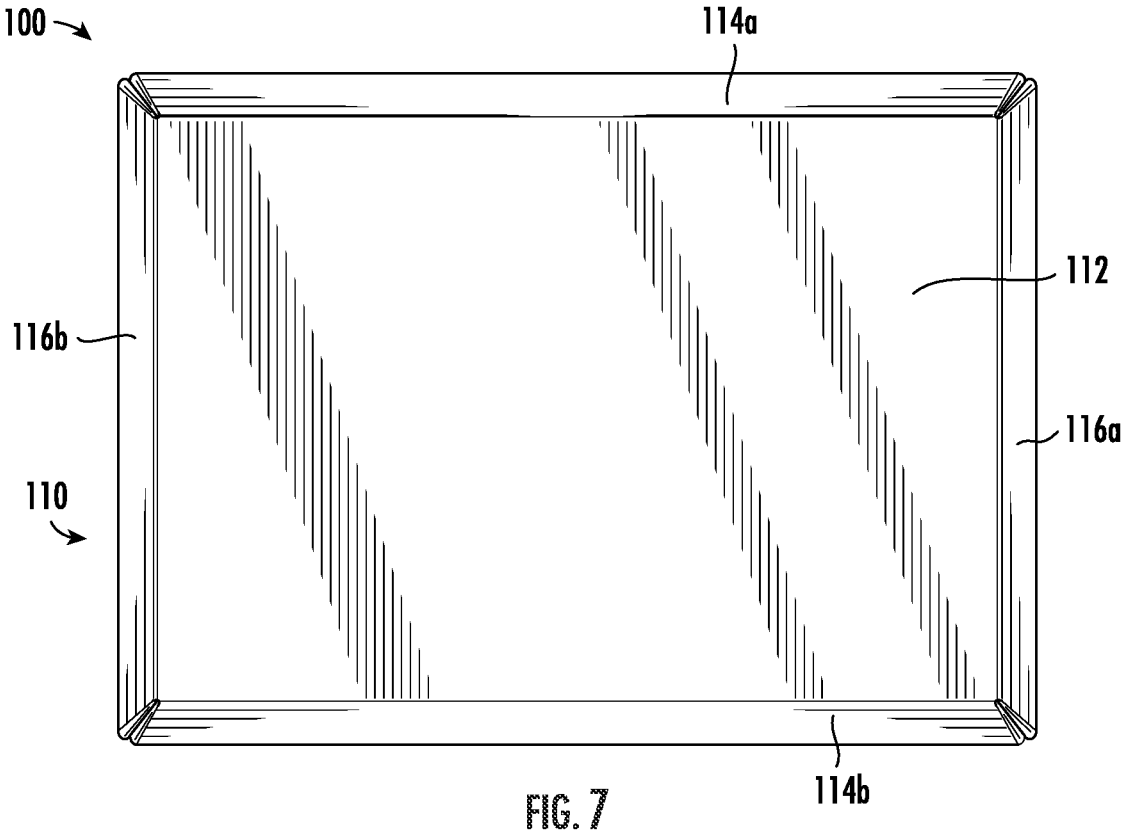
Figure 8:
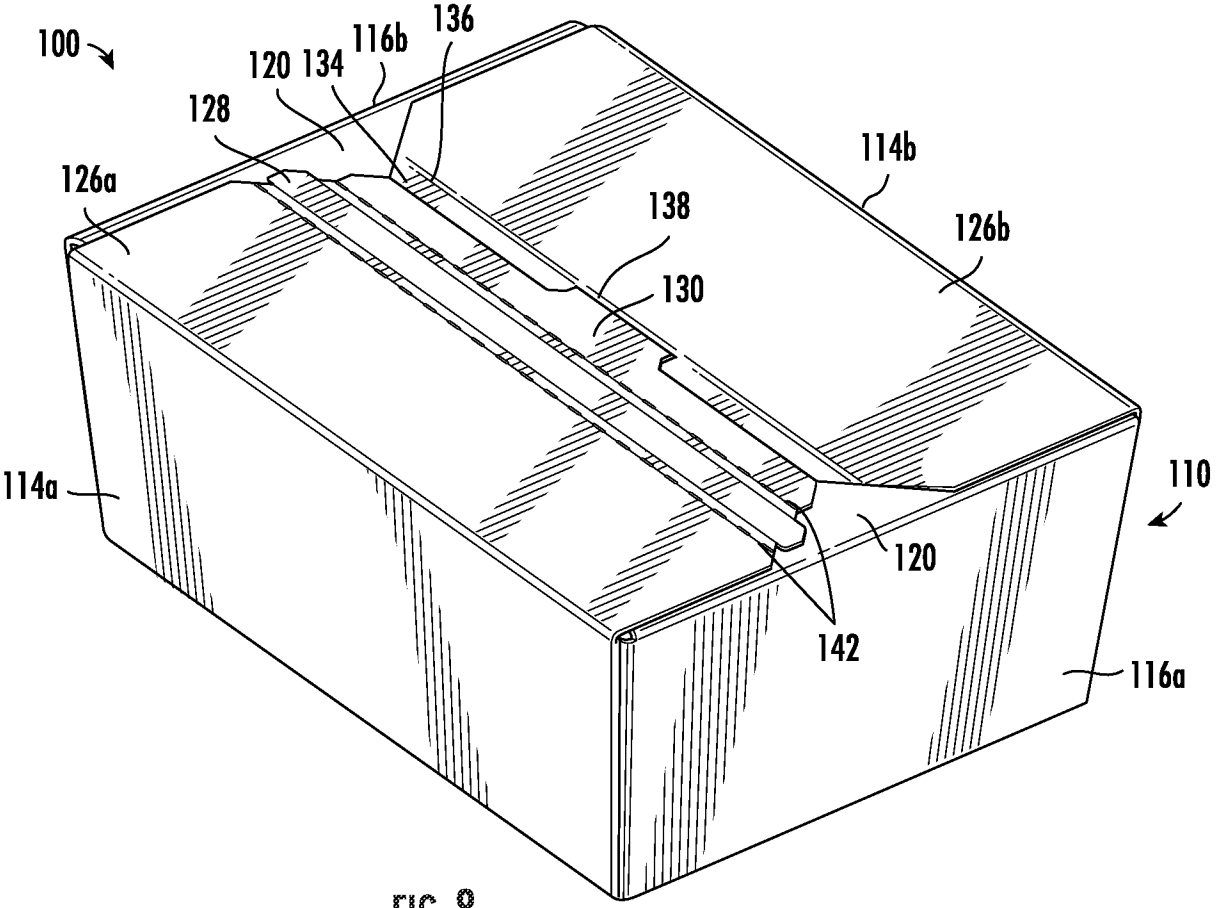
Figure 9:
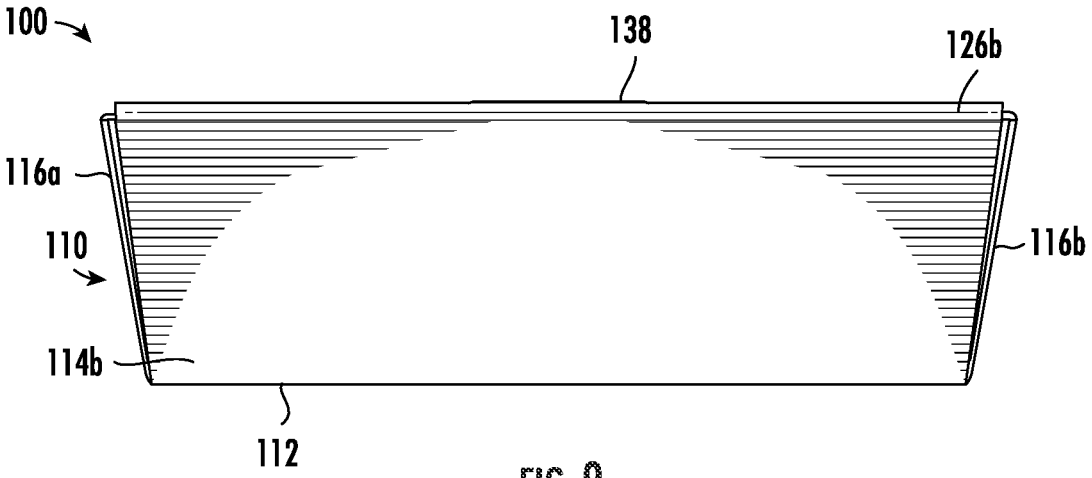
Figure 10:
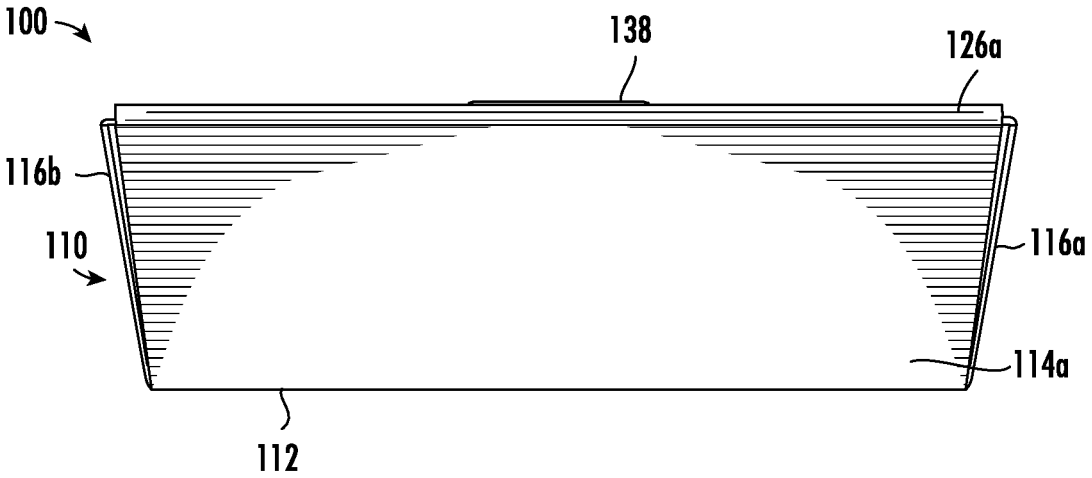
Figure 11:
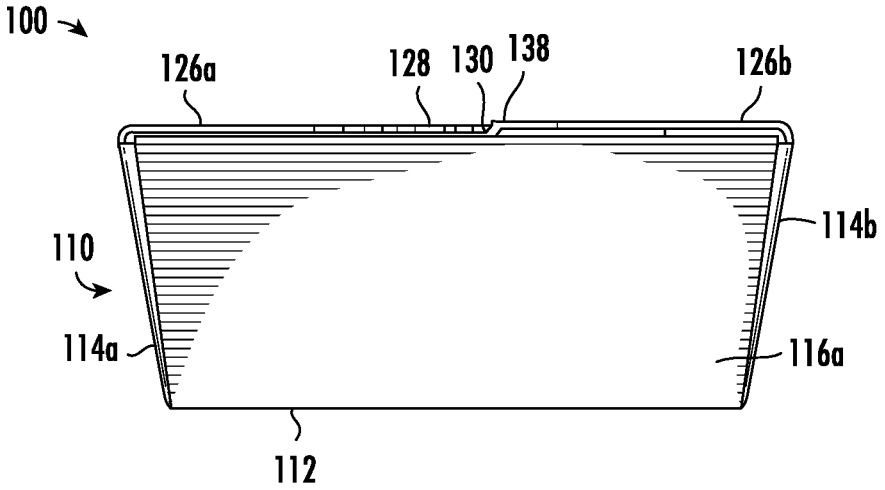
Figure 12:
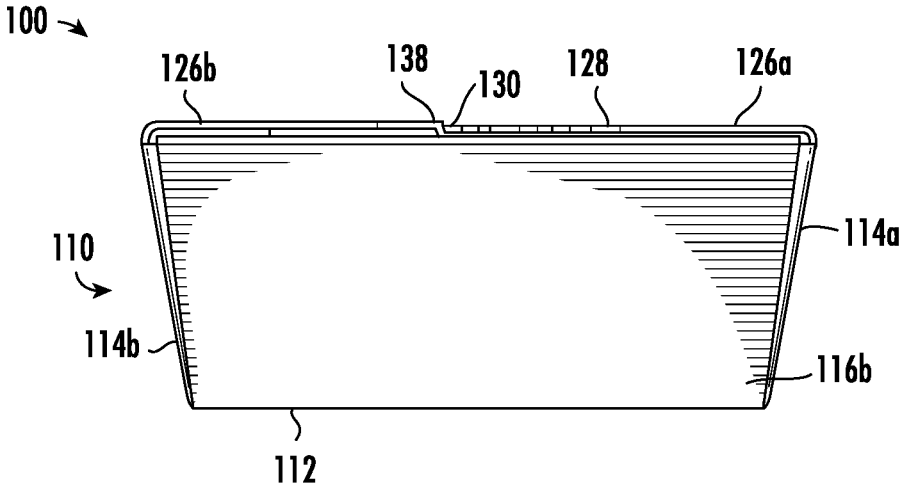
Figure 13:
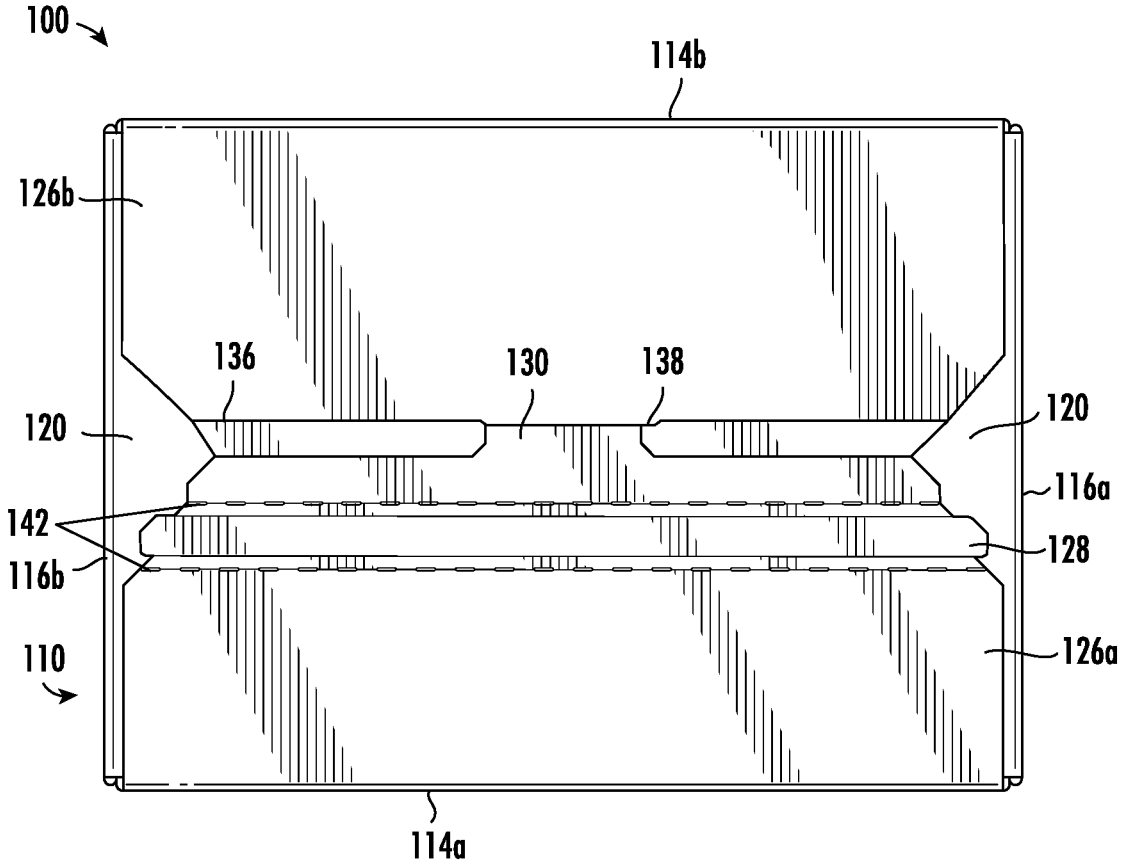
Figure 14:
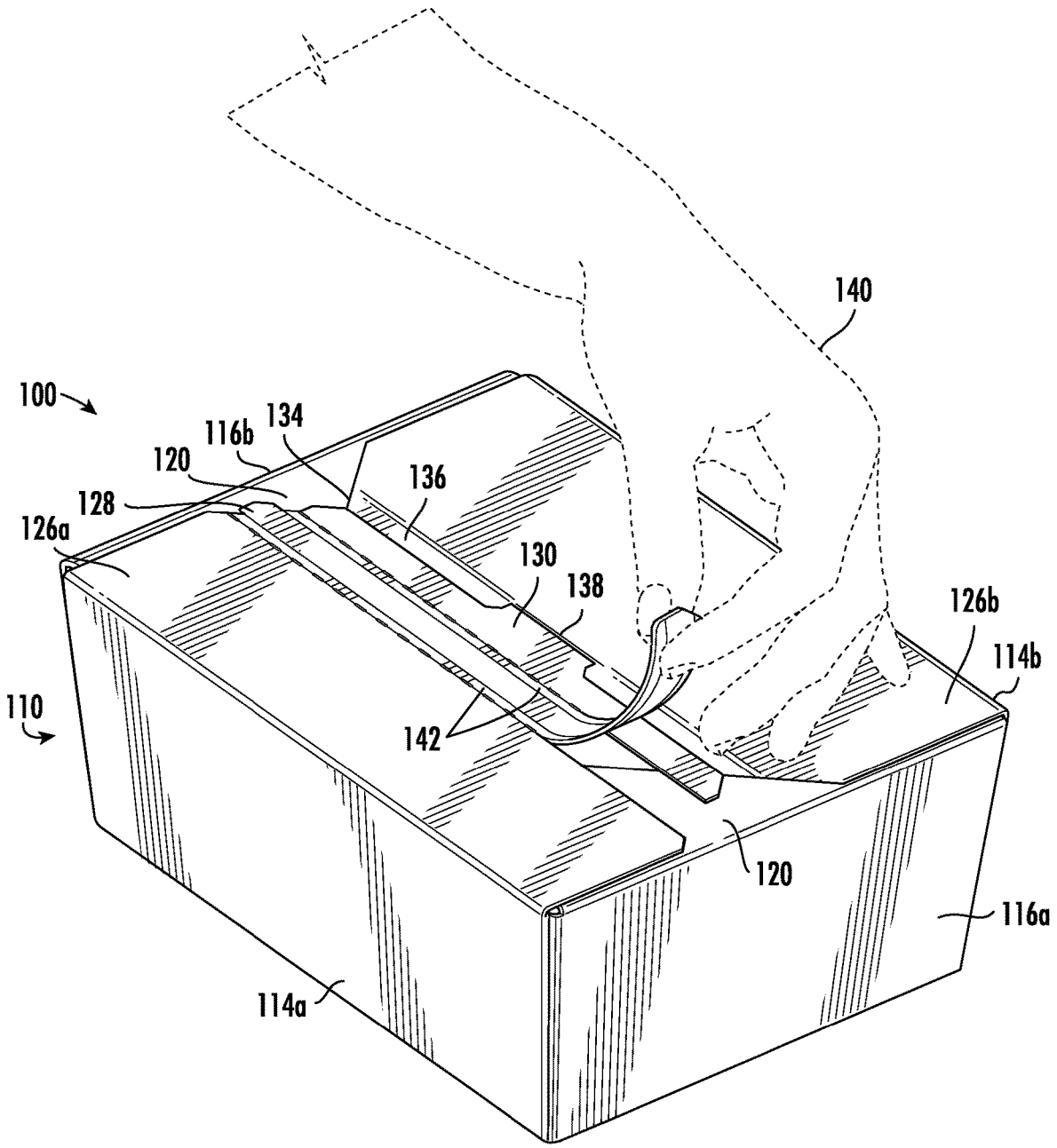
Figure 15:
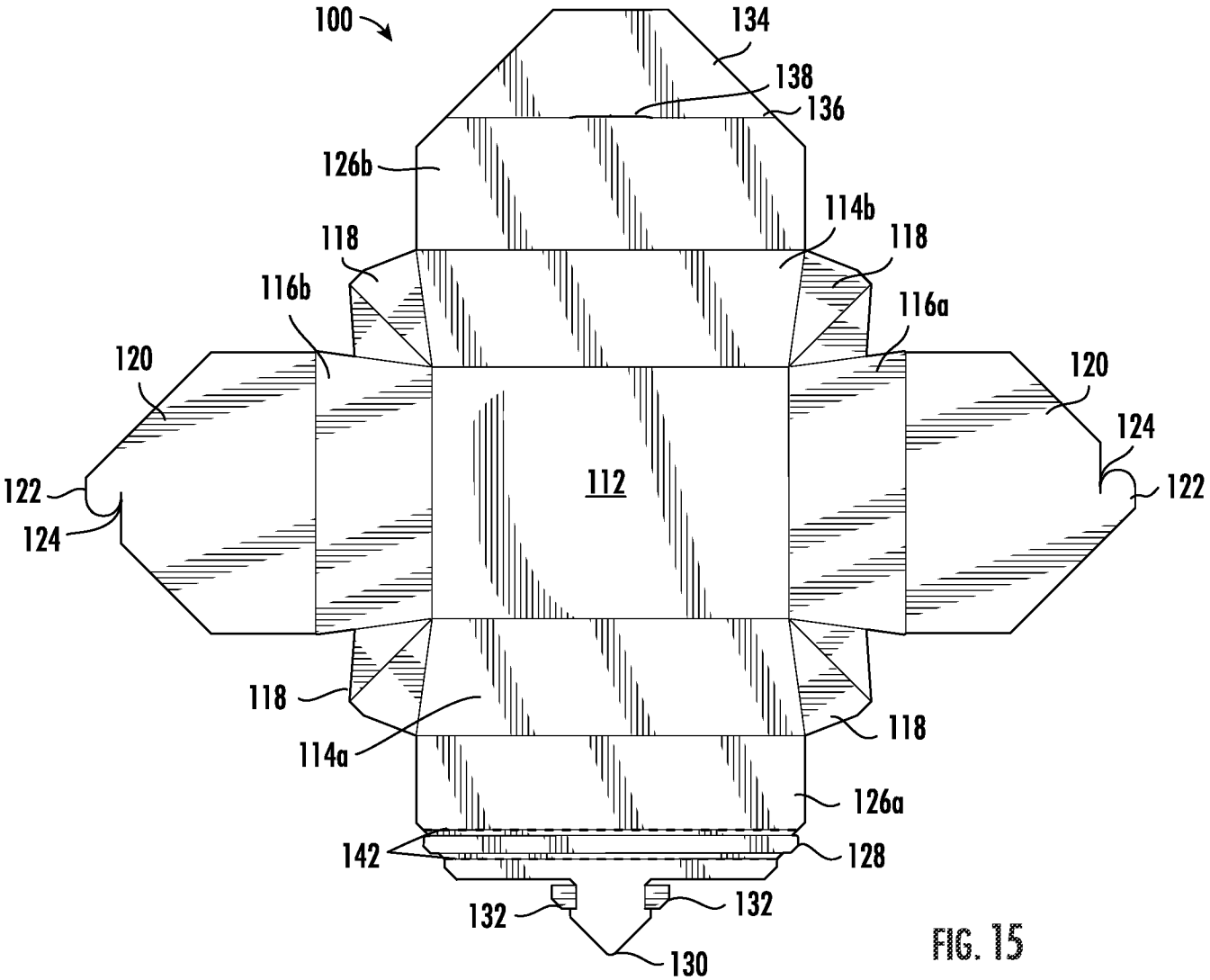
Figure 16:
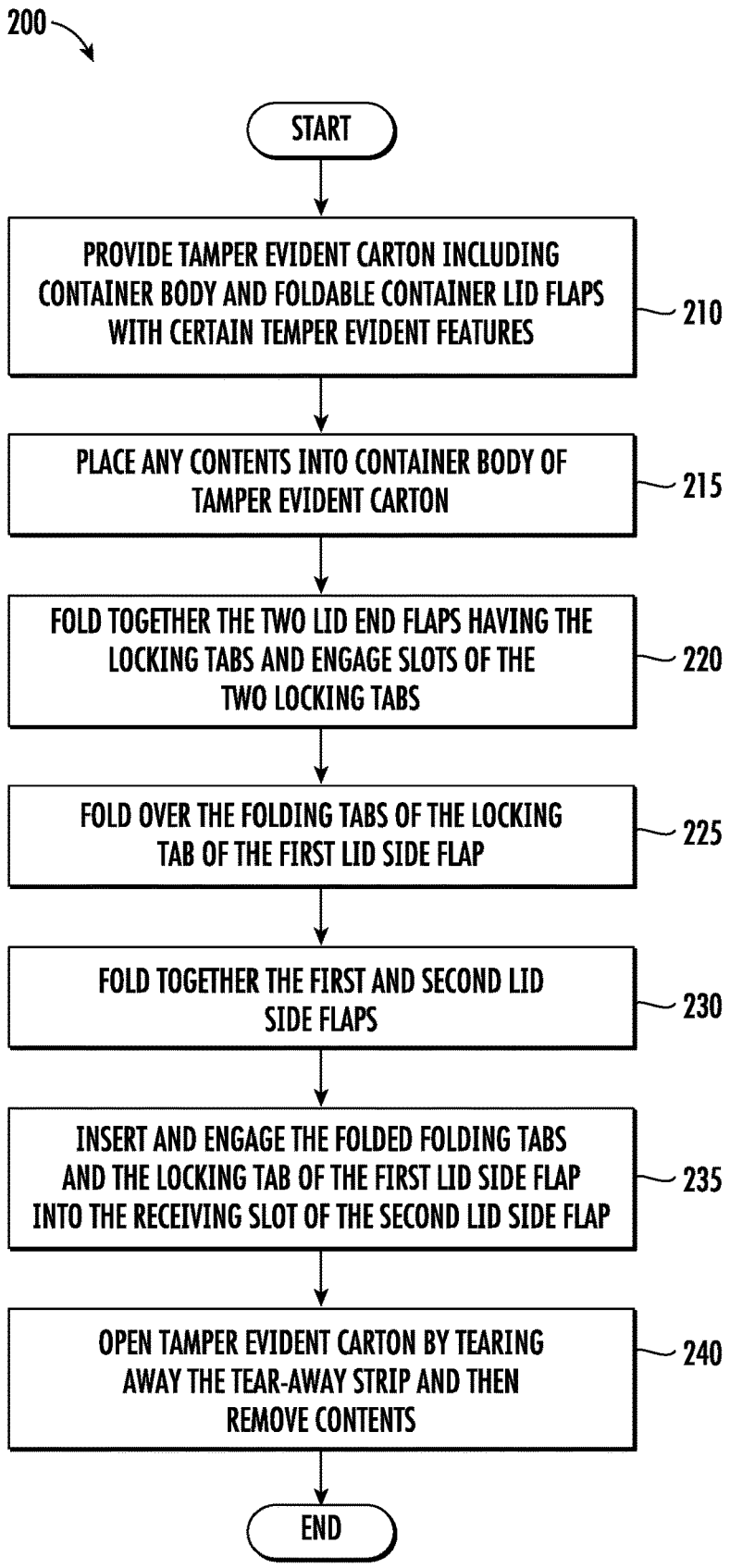

Having thus described the presently disclosed subject matter in general terms, reference will now be made to the accompanying drawings, which are not necessarily drawn to scale, and wherein:

FIG. 1 is a perspective view of a tamper evident carton in accordance with an embodiment of the invention;

FIG. 2 is a front elevation view of the tamper evident carton in accordance with an embodiment of the invention;

FIG. 3 is a rear elevation view of the tamper evident carton in accordance with an embodiment of the invention;

FIG. 4 is a left side elevation view of the tamper evident carton in accordance with an embodiment of the invention;

FIG. 5 is a right side elevation view of the tamper evident carton in accordance with an embodiment of the invention;

FIG. 6 is a top plane view of the tamper evident carton in accordance with an embodiment of the invention;

FIG. 7 is a bottom plane view of the tamper evident carton in accordance with an embodiment of the invention;

FIG. 8 is another perspective view of the tamper evident carton of FIG. 1 shown in a closed configuration in accordance with an embodiment of the invention;

FIG. 9 is a front elevation view of the tamper evident carton of FIG. 8 in accordance with an embodiment of the invention;

FIG. 10 is a rear elevation view of the tamper evident carton of FIG. 8 in accordance with an embodiment of the invention;

FIG. 11 is a left side elevation view of the tamper evident carton of FIG. 8 in accordance with an embodiment of the invention;

FIG. 12 is a right side elevation view of the tamper evident carton of FIG. 8 in accordance with an embodiment of the invention;

FIG. 13 is a top plane view of the tamper evident carton of FIG. 8 in accordance with an embodiment of the invention;

FIG. 14 is another perspective view of the tamper evident carton of FIG. 8 shown with a tamper evident strip partially removed in accordance with an embodiment of the invention;

FIG. 15 is a top plane view of the tamper evident carton of FIGS. 1 and 8 shown in a flat unfolded configuration in accordance with an embodiment of the invention; and FIG. 16 is a flow diagram of an example method of using the tamper-evident carton in accordance with an embodiment of the invention.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

In some embodiments, the subject matter of the invention provides a tamper evident carton and method of using same. In one example, the subject tamper evident carton may be a food carton and may be a disposable tamper evident food carton that is, for example, a cardboard-, paper-, and/or paperboard-based carton.

In some embodiments, the subject tamper evident carton may include a carton body and a set of four carton lid flaps, and wherein the carton body includes a floor panel and side panels that may be coupled via webbed corners. Accordingly, the subject tamper evident carton may be used as, for example, a disposable food carry-out (or take-out) carton that is suitable for holding wet foods reliably for some useful period of time.

In some embodiments, the webbed corners of the subject tamper evident carton may be held by glue or other adhesive.

In some embodiments, the carton body and/or hinged carton lid of the subject tamper evident carton may include various tabs and slots that may be engaged for holding shut the four carton lid flaps to the carton body.

In some embodiments, the carton body and/or the carton lid flaps of the subject tamper evident carton may include one of more tamper-evident features that may be used to indicate a "secure" condition of the carton and wherein the tamper-evident feature may be, for example, the condition of certain closure mechanisms (e.g., flaps, tabs, and/or slots), a perforated tear line, a tear-away strip, and/or the like.

In some embodiments, the subject tamper evident carton may include a substantially flat carton lid that allows for easy stacking of multiple of the presently disclosed tamper-evident cartons.

Additionally, a method of using the subject tamper evident carton is provided.

FIGS. 1-7 are views of an example of the subject tamper evident carton 100 in a substantially open state. FIGS. 8-14 are views of an example of the subject tamper evident carton 100 in a substantially closed state. FIG. 15 is a view of an example of the subject tamper evident carton 100 shown in a substantially closed, but partially compromised state. FIG. 16 shows a plan view of an example of the subject tamper evident carton 100. That is, FIG. 16 shows tamper-evident carton 100 in a flat pre-folded configuration. With respect to forming, for example, paperboard products, this flat pre-folded configuration is also called a "blank."

The tamper-evident carton 100 may include a carton body 110, a pair of foldable lid end flaps 120, and a pair of foldable lid side flaps 126 (e.g., side flaps 126*a*, 126*b*). For example, the carton body 110 may include a floor panel 112, two opposing side panels 114 (e.g., side panels 114*a*, 114*b*), and two opposing end panels 116 (e.g., end panels 116*a*, 116*b*). The ends of the side panels 114 and the end panels 116 may be coupled via webbed corners 118. The webbed corners 118 may be, for example, a webbed corner inside (or outside) glue design. The webbed corners 118 may be secured, for example, via an adhesive, thermal bonding, or any other suitable technique or mechanism. Each of the end panels 116 may include a foldable lid end flap 120 that has a locking tab 122 with a slot 124. The side panel 114*a* may include a foldable lid side flap 126*a*. The side panel 114*b* may include a foldable lid side flap 126*b*. Further, the lid side flap 126*a* may include a tear-away strip 128 and a locking tab 130 that may be flanked by two folding tabs 132. The lid side flap 126*b* may include a folding portion 134 along a fold line 136 that has a receiving slot 138 for receiving locking tab 130 of the lid side flap 126*a*.

With respect to tamper-evident carton 100 being, for example, a disposable tamper-evident food carton, tamper-evident carton 100 may be formed of any lightweight, rigid or semi-rigid material that is suitable for holding and/or transporting, for example, a quantity of food and that is also suitable for disposing of after use. For example, the tamper-evident carton 100 may be formed of corrugated cardboard, paper, paperboard, post-consumer paperboard (i.e., recycled materials), biodegradable materials (e.g., sugarcane and paper), polystyrene foam (e.g., Styrofoam), plastic, molded fiber, and the like.

The tamper-evident carton 100 may include certain tamper-evident features that may be used to indicate a "secure" condition. The tear-away strip 128 and tamper-evident features as indicated by the condition of the locking tab 130, folding tabs 132, receiving slot 138, and/or locking tabs 122 with slots 124 are examples of the tamper-evident features of the tamper-evident carton 100. In one example, when the tear-away strip 128 is fully intact (see for example FIGS. 8, 13), the tamper-evident carton 100 is in the "secure" condition. By contrast, when the tear-away strip 128 is shown to be compromised (see for example FIG. 15), the tamper-evident carton 100 is in a "tamper-evident" condition. In another example, when the locking tab 130, folding tabs 132, receiving slot 138, and/or locking tabs 122 with slots 124 are fully intact and fully engaged (see for example FIGS. 8, 13), the tamper-evident carton 100 is in the "secure" condition. By contrast, when any one or more of the locking tab 130, folding tabs 132, receiving slot 138, and/or locking tabs 122 with slots 124 is shown to be compromised (e.g., torn, partially or fully missing, and/or not fully engaged), the tamper-evident carton 100 is in a "tamper-evident" condition.

In one embodiment tamper-evident carton 100 may be closed folding together the two lid end flaps 120 and engaging the opposing locking tabs 122 using the slots 124. Engaging the opposing locking tabs 122 helps prevent anyone from reaching into the tamper-evident carton 100 from above the two lid end flaps 120 after the tamper-evident carton 100 is fully closed and in the "secure" condition.

The lid side flap 126*a* and the lid side flap 126*b* may then be folded together. More specifically, locking tab 130 of the lid side flap 126*a* engages with the receiving slot 138 of the lid side flap 126*b*. For example, before the locking tab 130 is engaged in the receiving slot 138, the folding tabs 132 may be folded over fully against the inside surface of the locking tab 130. Then, while holding the folding tabs 132 folded over flat against the inside surface of the locking tab 130, both the locking tab 130 and the folded folding tabs 132 may be inserted into the receiving slot 138 of the lid side flap 126*b*. Once the locking tab 130 and the folded folding tabs 132 are fully inserted into the receiving slot 138, the folding tabs 132 pop out to at least a partially unfolded state and lock inside the lid side flap 126*b* at the receiving slot 138.

In one example, the folding tabs 132 may be folded around the locking tab 130. Two other phots show the tamper-evident carton 100 fully closed with the locking tab 130 engaged in the receiving slot 138.

In one example, to open the tamper-evident carton 100, a user 140 may grasp the tear-away strip 128 and then pull and tear it away. In one example, the tear-away strip 128 may be removed along perforation lines 142. In so doing, the lid side flap 126*b* is fully released from the closed or secure state. Accordingly, the tamper-evident carton 100 can be opened and the contents retrieved, as shown in FIG. 21 and FIG. 22. Further, FIG. 22 shows an example of how the locking tab 130 with the folding tabs 132 may be engaged with the receiving slot 138. One can see the any attempt to tamper with or otherwise disengage the locking tab 130 would likely result in the locking tab 130, one or both folding tabs 132, and/or the receiving slot 138 be visibly compromised (e.g., torn, partially missing, or fully missing).

FIG. 17 is a flow diagram of an example of a method 200 of using the tamper-evident carton 100. The method 200 may include, but is not limited to, the following steps.

At a step 210, the tamper-evident carton 100 that includes the carton body 110, the foldable lid end flaps 120, and the foldable lid side flaps 126 with certain temper-evident features is provided. The tear-away strip 128 and tamper-evident features as indicated by the condition of the locking tab 130, folding tabs 132, receiving slot 138, and/or locking tabs 122 with slots 124 are examples of the tamper-evident features of the tamper-evident carton 100.

At a step 215, any contents may be placed into the carton body 110 of the tamper-evident carton 100. For example, food may be placed into the tamper-evident carton 100.

At a step 220, the two lid end flaps 120 having the locking tabs 122 are folded together, then the slots 124 of the two locking tabs 122 are engaged.

At a step 225, the folding tabs 132 of the locking tab 130 of the lid side flap 126*a* are folded inward and flat around the locking tab 130.

At a step 230, the lid side flaps 126*a* and 126*b* are folded together.

At a step 235, the folded folding tabs 132 and the locking tab 130 of the lid side flap 126*a* are inserted into and engaged with the receiving slot 138 of the lid side flap 126*b*. For example, while holding the folding tabs 132 folded over flat against the inside surface of the locking tab 130, both the locking tab 130 and the folded folding tabs 132 are inserted into the receiving slot 138 of the lid side flap 126*b*. Once the locking tab 130 and the folded folding tabs 132 are fully inserted into the receiving slot 138, the folding tabs 132 pop out to at least a partially unfolded state and lock inside the lid side flap 126*b* at the receiving slot 138. The tamper-evident carton 100 is now fully closed and in the "secure" condition.

At a step 240, the tamper-evident carton 100 is opened by tearing away the tear-away strip 128. Then, any contents may be removed and the tamper-evident carton 100 may be discarded.

In summary and referring now again to FIG. 1 through FIG. 17, the tamper-evident carton 100 and the method 200 of using the tamper-evident carton 100 are provided. In one example, the presently disclosed tamper-evident food carton 100 may be a disposable tamper-evident food carton that is, for example, a cardboard-, paper-, and/or paperboard-based carton. In this example, the disposable tamper-evident food carton may include certain tamper-evident features, such as, but not limited to, the tear-away strip 128 and tamper-evident features as indicated by the condition of the locking tab 130, folding tabs 132, receiving slot 138, and/or locking tabs 122 with slots 124.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A tamper evident carton, comprising:

a. a floor panel;

b. side panels extending about a periphery of the floor panel;

c. corner gussets extending between adjacent side panels, wherein the bottom panel, side panels, and corner gussets are configurable to form a compartment region;

d. a first lid flap and a second lid flap opposite that of the first lid flap, wherein the first lid flap extends from an uppermost edge of a first one of the side panels forming a first moveable joint therebetween, and the second lid flap extends from an uppermost edge of a second one of the side panels opposite that of the first side panel forming a second moveable joint therebetween, and wherein the first lid flap and second lid flap comprise a first interlocking feature and a second interlocking feature, respectively, such that the first lid flap and second lid flap are configured to interlock with one another when in a folded closed configuration;

e. a third lid flap and a fourth lid flap opposite that of the third lid flap, wherein the third lid flap extends from an uppermost edge of a third one of the side panels forming a third moveable joint therebetween, and the fourth lid flap extends from an uppermost edge of a fourth one of the side panels opposite that of the third side panel forming a fourth moveable joint therebetween, and wherein the third lid flap and fourth lid flap comprise a third interlocking feature and a fourth interlocking feature, respectively, such that the third lid flap and fourth lid flap are configured to interlock with one another when in a folded closed configuration; and f. a tear strip disposed in one of the third lid flap or fourth lid flap, and wherein upon removal of the tear strip the third lid flap is releasable from the folded closed configuration without unlocking the third interlocking feature from the fourth interlocking feature.

2. The tamper evident carton of claim 1, wherein the first interlocking feature of the first lid flap comprises a first locking tab and slot and the second interlocking feature of the second lid flap comprises a corresponding second locking tab and slot, wherein the slot of the first locking tab and the slot of the corresponding second locking tab are configure to engage and interlock with one another to secure the first lid flap and the second lid flap in the folded closed configuration.

3. The tamper evident carton of claim 2, wherein the third interlocking feature of the third lid flap comprises a locking tab extending from an upper portion of the third lid flap, and wherein the locking tab comprises two folding tabs, one extending perpendicular out from each side of the locking tab.

4. The tamper evident carton of claim 3, wherein the fourth lid flap comprises a folding portion extending from an uppermost edge of the fourth lid flap forming a fifth moveable joint therebetween, and wherein the folding portion comprises a locking tab slot formed in the fifth moveable joint.

5. The tamper evident carton of claim 4, wherein the locking tab slot is configured to receive the locking tab with the two folding tabs in a folded position, wherein in the folded position the two folding tabs are folded substantially flat against a surface of the locking tab.

6. The tamper evident carton of claim 5, wherein the two folding tabs are configured to unfolded to a degree once fully inserted through the locking tab slot.

7. The tamper evident carton of claim 5, wherein once fully inserted through the locking tab slot the two folding tabs are configured to unfolded to a degree such that the locking tab cannot be removed from the locking tab slot without causing visible damage to at least one of the locking tab, locking tab slot, and/or one or both of the two folding tabs.

8. The tamper evident carton of claim 1, wherein the tear strip is disposed along a length of an upper portion of the third lid flap and below the third interlocking feature.

9. A method of securing contents in a tamper evident carton, comprising:

a. providing a tamper evident carton, comprising:

i. a floor panel;

ii. side panels extending about a periphery of the floor panel;

iii. corner gussets extending between adjacent side panels, wherein the bottom panel, side panels, and corner gussets are configurable to form a compartment region;

iv. a first lid flap and a second lid flap opposite that of the first lid flap, wherein the first lid flap extends from an uppermost edge of a first one of the side panels forming a first moveable joint therebetween, and the second lid flap extends from an uppermost edge of a second one of the side panels opposite that of the first side panel forming a second moveable joint therebetween, and wherein the first lid flap and second lid flap comprise a first interlocking feature and a second interlocking feature, respectively, such that the first lid flap and second lid flap are configured to interlock with one another when in a folded closed configuration;

v. a third lid flap and a fourth lid flap opposite that of the third lid flap, wherein the third lid flap extends from an uppermost edge of a third one of the side panels forming a third moveable joint therebetween, and the fourth lid flap extends from an uppermost edge of a fourth one of the side panels opposite that of the third side panel forming a fourth moveable joint therebetween, and wherein the third lid flap and fourth lid flap comprise a third interlocking feature and a fourth interlocking feature, respectively, such that the third lid flap and fourth lid flap are configured to interlock with one another when in a folded closed configuration; and vi. a tear strip disposed in one of the third lid flap or fourth lid flap, and wherein upon removal of the tear strip the third lid flap is releasable from the folded closed configuration without unlocking the third interlocking feature from the fourth interlocking feature;

b. inserting contents into the compartment region;

c. interlocking the first lid flap and the second lid flap together; and d. interlocking the third lid flap and the fourth lid flap together.

10. The method of claim 9, wherein interlocking the first lid flap and the second lid flap together, comprises folding the first lid flap and the second lid flap together and interlocking the first interlocking feature of the first lid flap with the second interlocking feature of the second lid flap.

11. The method of claim 10, wherein the first interlocking feature of the first lid flap comprises a first locking tab and slot and the second interlocking feature of the second lid flap comprises a corresponding second locking tab and slot, wherein the slot of the first locking tab and the slot of the corresponding second locking tab are configure to engage and interlock with one another to secure the first lid flap and the second lid flap in the folded closed configuration.

12. The method of claim 11, wherein interlocking the third lid flap and the fourth lid flap together, comprises folding the third lid flap and the fourth lid flap together and interlocking the third interlocking feature of the third lid flap with the fourth interlocking feature of the fourth lid flap.

13. The method of claim 12, wherein the third interlocking feature of the third lid flap comprises a locking tab extending from an upper portion of the third lid flap, and wherein the locking tab comprises two folding tabs, one extending perpendicular out from each side of the locking tab.

14. The method of claim 13, wherein the fourth lid flap comprises a folding portion extending from an uppermost edge of the fourth lid flap forming a fifth moveable joint therebetween, and wherein the folding portion comprises a locking tab slot formed in the fifth moveable joint.

15. The method of claim 14, wherein interlocking the third lid flap and the fourth lid flap together further comprises, folding the two folding tabs into a folded position substantially flat against a surface of the locking tab and inserting the locking tab into the locking tab slot.

16. The method of claim 15, wherein the two folding tabs are configured to unfolded to a degree once fully inserted through the locking tab slot.

17. The method of claim 16, wherein once fully inserted through the locking tab slot the two folding tabs are configured to unfolded to a degree such that the locking tab cannot be removed from the locking tab slot without causing visible damage to at least one of the locking tab, locking tab slot, and/or one or both of the two folding tabs.

18. A method of providing access to contents in a secured tamper evident carton, comprising:

a. providing a secured tamper evident carton with contents therein, the tamper evident carton comprising:

i. a floor panel;

ii. side panels extending about a periphery of the floor panel;

iii. corner gussets extending between adjacent side panels, wherein the bottom panel, side panels, and corner gussets are configurable to form a compartment region;

iv. a first lid flap and a second lid flap opposite that of the first lid flap, wherein the first lid flap extends from an uppermost edge of a first one of the side panels forming a first moveable joint therebetween, and the second lid flap extends from an uppermost edge of a second one of the side panels opposite that of the first side panel forming a second moveable joint therebetween, and wherein the first lid flap and second lid flap comprise a first interlocking feature and a second interlocking feature, respectively, such that the first lid flap and second lid flap are configured to interlock with one another when in a folded closed configuration;

v. a third lid flap and a fourth lid flap opposite that of the third lid flap, wherein the third lid flap extends from an uppermost edge of a third one of the side panels forming a third moveable joint therebetween, and the fourth lid flap extends from an uppermost edge of a fourth one of the side panels opposite that of the third side panel forming a fourth moveable joint therebetween, and wherein the third lid flap and fourth lid flap comprise a third interlocking feature and a fourth interlocking feature, respectively, such that the third lid flap and fourth lid flap are configured to interlock with one another when in a folded closed configuration; and vi. a tear strip disposed in one of the third lid flap or fourth lid flap, and wherein upon removal of the tear strip the third lid flap is releasable from the folded closed configuration without unlocking the third interlocking feature from the fourth interlocking feature;

b. removing the tear strip;

c. folding open the third lid flap and the fourth lid flap;

d. unlocking the first interlocking feature of first lid flap from the second interlocking feature of the second lid flap; and e. folding open the first lid flap and the second lid flap.

19. The method of claim 18, wherein the tear strip is disposed along a length of an upper portion of the third lid flap and below the third interlocking feature.

* * * * *